US005133328A

United States Patent [19]

Sato et al.

[11] Patent Number: 5,133,328

[45] Date of Patent: Jul. 28, 1992

[54] BUILT-IN DISCHARGE BULB TYPE IGNITION PLUG

[75] Inventors: Takashi Sato; Hiromitsu Tsuchiya; Tetsuya Mitani, all of Shizuoka, Japan

[73] Assignee: Yazaki Corporation, Tokyo, Japan

[21] Appl. No.: 741,904

[22] Filed: Aug. 8, 1991

[30] Foreign Application Priority Data

Aug. 9, 1990 [JP] Japan ..... 2-209219

[51] Int. Cl.[5] ..... F02P 15/00; H01J 7/44; H01T 13/40

[52] U.S. Cl. ..... 123/627; 123/169 EL; 313/123

[58] Field of Search ..... 123/169 EL, 627; 313/123, 124, 142

[56] References Cited

U.S. PATENT DOCUMENTS

| | | | |
|---|---|---|---|
| 1,523,522 | 1/1925 | Graf | 313/124 X |
| 1,671,740 | 5/1928 | Phillips | 313/124 X |
| 3,324,347 | 6/1967 | Brugnola | 313/123 X |
| 4,549,114 | 10/1985 | Herden | 313/123 X |
| 4,770,152 | 9/1988 | Mogi et al. | 123/627 X |
| 4,944,280 | 7/1990 | Washington | 123/627 |

FOREIGN PATENT DOCUMENTS

| | | | |
|---|---|---|---|
| 0574316 | 6/1924 | France | 313/124 |
| 1366529 | 11/1971 | United Kingdom . | |
| 1573445 | 8/1980 | United Kingdom . | |
| 2147049 | 5/1985 | United Kingdom | 313/123 |

OTHER PUBLICATIONS

Research Disclosure, May 1988, Kenneth Mason Publications, 289122 p. 355.

*Primary Examiner*—Willis R. Wolfe
*Attorney, Agent, or Firm*—Armstrong, Nikaido, Marmelstein, Kubovcik & Murray

[57] ABSTRACT

An ignition system has a series-gap discharge-bulb through which a high voltage is supplied to a center electrode of an ignition plug. A short-circuit element is made of a material that reversibly deforms when it is heated to a predetermined temperature when an engine is operated in a steady state. The short-circuit element is electrically connected to the plug such that two discharging electrodes are short-circuited by the short-circuit element when the short-circuit element is heated to thermally deform. The discharging electrodes may be made of a reversibly deformable material so that the electrodes deform into contact with each other when they are heated to a predetermined temperature.

9 Claims, 3 Drawing Sheets

PRIOR ART

BUILT-IN DISCHARGE BULB TYPE IGNITION PLUG

BACKGROUND OF THE INVENTION

1. Field of the Invention

The present invention relates to an ignition system primarily for a gasoline engine and more particularly to an ignition system where a discharge bulb for a series gap is built in.

2. Prior Art

An ignition system for a gasoline engine where a high voltage is applied to the ignition plug to produce a spark, may suffer from the problem that deteriorated ignition performance due to current leakage can cause a failure in starting the engine if the ignition plug has poor insulation characteristic due to incomplete combustion or other causes. Also, combustion and ignition require higher discharge voltages and spark energy at lower temperatures below zero than at normal temperatures. Thus, it has been a simple and effective way to overcome these difficulties that high voltages are applied to an ignition plug via a series gap. In order to properly control ignition timing for effective use of series gap, it is necessary that the threshold discharge voltage of series gap is selected to be sufficiently high as compared to that of ignition plug. The use of series gap imposes severe requirements of sustaining voltages of ignition coils and high voltage cords.

Published Japanese Patent Application No. 51-32180 discloses one such ignition plug provided with a built-in discharge bulb for a series gap. This plug is an ignition plug shown in FIG. 5 where opposed electrodes extend into a discharge bulb having an inert gas charged therein. A center electrode 2 is coupled at its rear end to one 8 of the electrodes via a wire 10 while a high voltage terminal 5 is coupled at its front end to the other 7 electrode via a wire 9.

Such conventional built-in series-gap type ignition plug has electrodes that are under repeated discharge at all times during operation of an engine. The series gap plays its important role when the engine is started and for a subsequent short time period of about few minutes or little more than then minutes until the engine is warm enough. The series gap is not necessary once the engine reaches its steady running state. With the conventional ignition system, the series gap remains under repeated discharge during steady operation of engine as well. This not only causes wear and tear of electrodes leading to a shortened life of the discharge bulb but also imposes severe requirements of high-voltage sustaining characteristic on the ignition coil and high voltage cords.

SUMMARY OF THE INVENTION

An object of the invention is to provide a built-in discharge bulb type ignition plug where the electrodes are automatically interrupted their series gap operation when the engine reaches a steady state of operation so as to ensure longer life of a discharge bulb.

An ignition system has a series-gap discharge-bulb through which a high voltage is supplied to a center electrode of an ignition plug. A short-circuit element is made of a material that reversibly deforms when it is heated to a predetermined temperature when an engine is operated in a steady state. The short-circuit element is electrically connected to the plug such that two discharging electrodes are short-circuited by the short-circuit element when the short-circuit element is heated to deform. The discharging electrodes may be made of a reversibly deformable material so that the electrodes deform into contact with each other when they are heated to a predetermined temperature.

BRIEF DESCRIPTION OF THE DRAWINGS

Features and other objects of the invention will be more apparent from the description of the preferred embodiments with reference to the accompanying drawings in which.

DETAILED DESCRIPTION OF THE PREFERRED EMBODIMENTS

Construction

A built-in discharge bulb type ignition plug according to the present invention will now be described with reference to drawings. Elements similar to those of the conventional ignition plug have been given the same references.

Figure 1A:
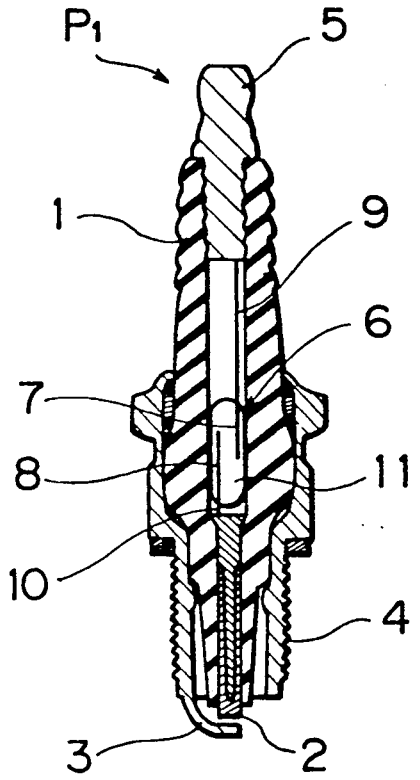
FIG. 1A is a cross-sectional view of a first embodiment of a built-in discharge bulb type ignition plug according to the present invention.
Figures 1B, 1C, 1D, 1E:
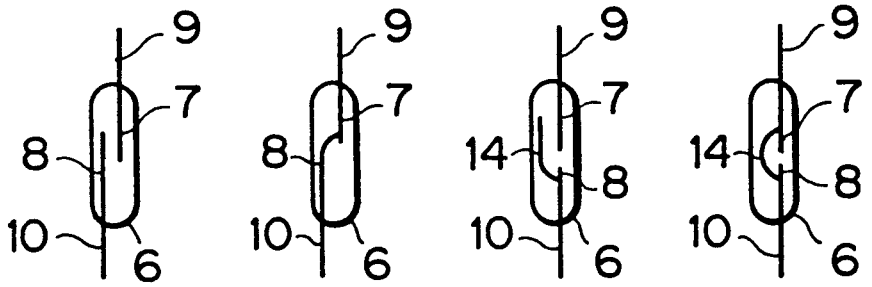
FIG. 1B shows a built-in discharge bulb of FIG. 1A before an engine is started.
FIG. 1C shows a built-in discharge bulb of FIG. 1A after the engine reaches its steady state.
FIG. 1D shows a built-in discharge bulb of a second embodiment before the engine is started.
FIG. 1E shows a built-in discharge bulb of FIG. 1D after the engine reaches its steady state.

FIG. 1A shows a first embodiment of the present invention. An ignition plug P1 has a discharge bulb 6 in which an inert gas 11 is charged. The ignition plug P1 is threaded at a threaded portion 4 into a combustion chamber of an engine. When the engine is to be started, there is a predetermined gap between an electrode 8 and an electrode 7 as shown in FIG. 1B, and discharges takes place across the predetermined gap playing the important role of a series gap. Once the engine is started, the ground electrode 3 is heated by combustion heat. The heat is transferred through the threaded portion to the cylinder head which is cooled with water or air. The tip end of the center electrode 2 of ignition plug P1 faces the combustion chamber, being heated to high temperatures. Then, the heat of electrode 2 is transferred via wire 10 directly to the electrode 8. The electrode 8 is formed in a bimetal construction such that the short-circuit element 14 bends at high temperatures when the electrode is heated during normal engine operation, so that the deformed tip of the bimetal comes into contact with the electrode 7 as shown in FIG. 1C, interrupting the series gap discharge. The electrode 7 may also be of a bimetal construction that is deformed into deflection at high temperatures. The proper selection of length and thickness of the wire 10 makes it possible to control heat transfer at will. The construction according to the invention greatly reduces the number of repeated discharges of discharge bulb, allowing to replace the inert gas with air.

FIG. 1D shows a modified first embodiment of the invention. The electrodes 7 and 8 are both fixed conventional electrodes. The electrode 8 is provided with a short-circuit element 14 made in a bimetal material construction and the distance between the short-circuit element 14 and electrode 7 is greater than that between the electrodes 7 and 8. The short-circuit element 14 is thermally deformed during the steady state operation of engine so as to short-circuit the electrodes 7 and 8 as shown in FIG. 1E.

Figure 2:
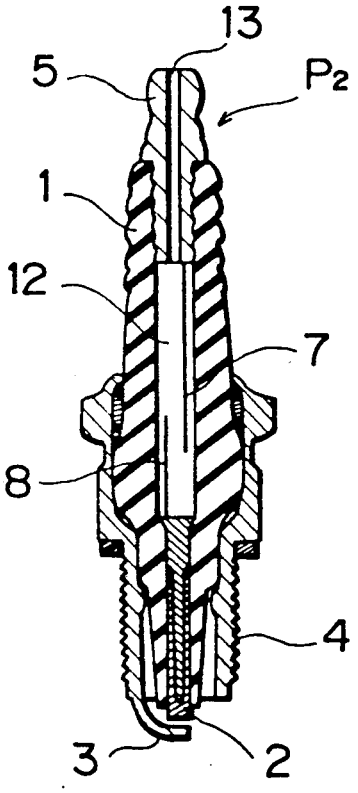
FIG. 2 is a cross-sectional view of an ignition plug having a built-in discharge bulb open to atmosphere.

FIG. 2 shows a second embodiment of an ignition plug P2 having an open-to-air type discharge bulb is used in place of a gas-charged type discharge bulb. A hole 13 communicating with atmosphere is provided at the side of a high voltage terminal 5 so that materials produced by sparks within the discharge bulb may be exhausted into atmosphere. The other operations and advantages are the same as those in the ignition plug P1 in FIG. 1A.

Figure 3:
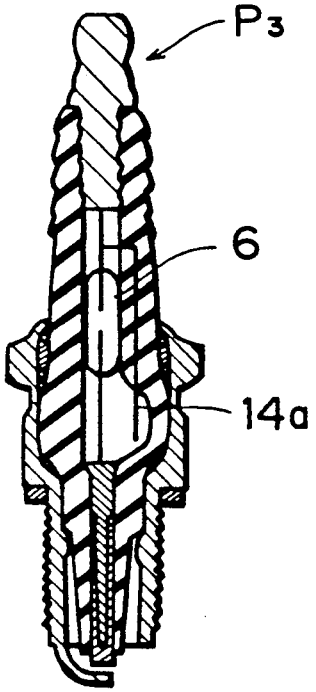
FIG. 3 is a cross-sectional view of an ignition plug having a short-circuit element provided outside the discharge bulb.

FIG. 3 shows an ignition plug P3 of a third embodiment of the invention where a short-circuit element 14*a* is provided at the outside of the discharge bulb 6 rather than within the discharge bulb.

Figure 4:
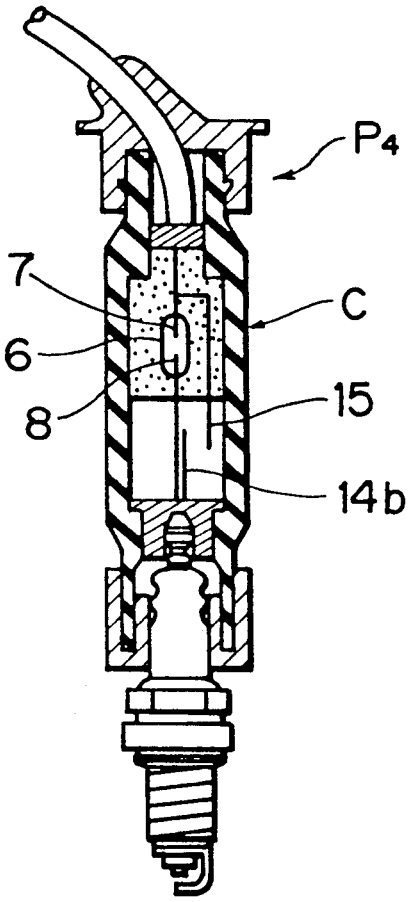
FIG. 4 is a cross-sectional view of an ignition plug having a short-circuit element provided outside the discharge bulb.
Figure 5:
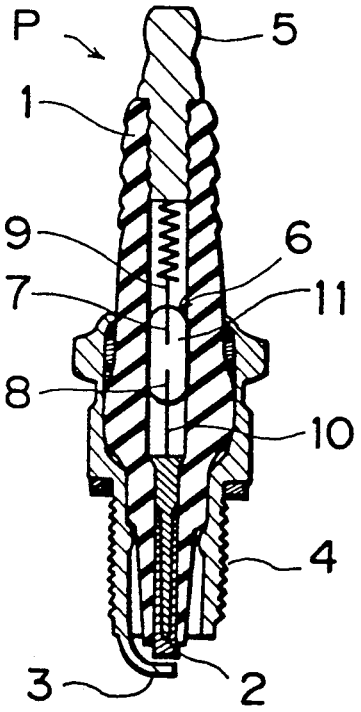
FIG. 5 is a cross-sectional view of a conventional built-in discharge type ignition plug.

FIG. 4 shows an ignition plug P4 of a fourth embodiment of the invention where the discharge bulb 6 is provided within a plug cap C, and a short-circuit element 14*b* in the form of bimetal connected to the external portion of electrode 8 and the contact element 15 connected to the external portion of electrode 7 are disposed such that the elements 14*b* and 15 form a short circuit in parallel with the discharge bulb when the elements are reversibly bent.

The present invention is not limited to the embodiments mentioned above, and a variety of modifications may of course be made. The short-circuit element may be of a temperature sensitive deformable structure that bends when heated. Such structures include a combination of ordinary electrically conductive materials, bimetal, and electrodes, and appropriate structures using shape memory alloys.

Operation

The series gap operates as it is designed for when the engine is started and for a subsequent period until the engine is sufficiently warmed up. When the engine is in a steady state operation thereof, a heat is transferred from the center electrode of the plug exposed to a high temperature to the electrodes of discharge bulb as well as to the short-circuit element so that the electrodes and short-circuit element are heated to a predetermined high temperature while also reversibly bending into an arcuate shape so as to be in contact with the other electrode. Thus, the discharge electrodes are effectively short-circuited by the short-circuit element so that the high voltage is supplied directly to the center electrode.

An engine is normally started at air temperatures ranging from 30 degrees below zero to 30 degrees above zero. However, when the engine is operating in the steady state, the tip end of the ignition plug reaches temperatures as high as several hundred degrees Celsius. This allows a large magnitude of bending of the short-circuit element. The operating temperature of the electrodes and short-circuit element may be properly selected depending on where the discharge bulb is located within the ignition plug.

When the engine is stopped, the temperatures of electrodes and short-circuit element go down and the electrodes are no longer short-circuited till the plug is again heated to a predetermined high temperature.

What is claimed is:

1. A built-in discharge bulb type ignition plug having a series-gap discharge-bulb through which a high voltage is supplied to a center electrode of the ignition plug, wherein said series-gap discharge-bulb has two electrodes across which discharge takes place, said electrodes being short-circuited at a predetermined temperature when an engine is operated in a steady state.

2. A built-in discharge bulb type ignition plug according to claim 1, wherein said discharge bulb further includes a first short-circuit element mounted to at least one of said two electrodes within said discharge bulb, said first short-circuit element reversibly deform so as to come into contact with the other electrode when said first short-circuit element is heated to a predetermined temperature.

3. A built-in discharge bulb type ignition plug according to claim 1, wherein said ignition plug further includes a second short-circuit element mounted such that said second short-circuit element reversibly deforms to form a short-circuit in parallel with said series-gap discharge-bulb when said second short-circuit element is heated to a predetermined temperature.

4. A built-in discharge bulb type ignition plug according to claim 2, wherein said first and second short-circuit element are made of shape memory alloy.

5. A built-in discharge bulb type ignition plug according to claim 3, wherein said first and second short-circuit elements are made of bimetals.

6. A built-in discharge bulb type ignition plug according to claim 1, wherein said two electrodes reversibly deform so as to come into contact with each other when said electrodes are heated to a predetermined temperature.

7. A built-in discharge bulb type ignition plug according to claim 6, wherein said two electrodes are made of shape memory alloy.

8. A built-in discharge bulb type ignition plug according to claim 6, wherein said two electrodes are made of bimetals.

9. A built-in discharge bulb type ignition plug according to claim 1, wherein said discharge-bulb has a hole communicating with atmosphere.

* * * * *